US009283751B2

(12) United States Patent
Yamagata

(10) Patent No.: US 9,283,751 B2
(45) Date of Patent: Mar. 15, 2016

(54) LIQUID EJECTING APPARATUS AND METHOD OF CONTROLLING LIQUID EJECTING APPARATUS

(71) Applicant: Seiko Epson Corporation, Shinjuku-ku (JP)

(72) Inventor: Toshiyuki Yamagata, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/586,738

(22) Filed: Dec. 30, 2014

(65) Prior Publication Data

US 2015/0191010 A1 Jul. 9, 2015

(30) Foreign Application Priority Data

Jan. 6, 2014 (JP) ..... 2014-000064

(51) Int. Cl.
*B41J 29/38* (2006.01)
*B41J 2/045* (2006.01)

(52) U.S. Cl.
CPC ..... *B41J 2/04588* (2013.01); *B41J 2/04503* (2013.01); *B41J 2/04581* (2013.01); *B41J 2/04596* (2013.01)

(58) Field of Classification Search
CPC ..... B41J 2/04503
USPC ..... 347/11
See application file for complete search history.

(56) References Cited

U.S. PATENT DOCUMENTS

| | | | | |
|---|---|---|---|---|
| 6,257,689 | B1 * | 7/2001 | Yonekubo | B41J 2/04503 347/10 |
| 7,520,579 | B2 | 4/2009 | Yoshida | |
| 2003/0016257 | A1 | 1/2003 | Asauchi et al. | |
| 2003/0020772 | A1 * | 1/2003 | Morikawa | 347/10 |
| 2003/0085936 | A1 * | 5/2003 | Tanaka | 347/11 |
| 2007/0008356 | A1 | 1/2007 | Katoh | |
| 2014/0253620 | A1 * | 9/2014 | Watanabe | B41J 2/04588 347/11 |
| 2015/0210073 | A1 | 7/2015 | Yamagata | |

FOREIGN PATENT DOCUMENTS

| | | | |
|---|---|---|---|
| JP | 2000-280469 | A | 10/2000 |
| JP | 2004-330514 | A | 11/2004 |

OTHER PUBLICATIONS

Non-Final Office Action in related U.S. Appl. No. 14/603,230 dated Apr. 27, 2015, 10 pages.

* cited by examiner

*Primary Examiner* — Shelby Fidler
(74) *Attorney, Agent, or Firm* — Kilpatrick Townsend & Stockton LLP

(57) ABSTRACT

A liquid ejecting apparatus has a configuration in which a drive pulse is selectable from a first ejection drive pulse adjusted to a first ejection timing with respect to an LAT signal, a second ejection drive pulse adjusted to a second ejection timing which is earlier than the first ejection timing with respect to the LAT signal, and a third ejection drive pulse adjusted to a third ejection timing which is later than the first ejection timing with respect to the LAT signal, and is selected according to a moving speed of a recording head in acceleration/deceleration sections of the recording head.

5 Claims, 8 Drawing Sheets

LIQUID EJECTING APPARATUS AND METHOD OF CONTROLLING LIQUID EJECTING APPARATUS

BACKGROUND

This application claims priority to Japanese Patent Application No. 2014-000064, filed Jan. 6, 2014, the entirety of which is incorporated by reference herein.

1. Technical Field

The present invention relates to a liquid ejecting apparatus such as an ink jet-type recording apparatus and a method of controlling the liquid ejecting apparatus, and particularly to a liquid ejecting apparatus that applies a drive waveform included in a drive signal to a pressure generating unit and thereby drives the pressure generating unit, which causes a pressure change to occur in a liquid inside a pressure chamber that communicates with a nozzle, and thereby ejects the liquid from the nozzle, and to a method of controlling the liquid ejecting apparatus.

2. Related Art

A liquid ejecting apparatus includes a liquid ejecting head and ejects (discharges) various liquids from the liquid ejecting head. An Example of the liquid ejecting apparatus includes an image recording apparatus such as an ink jet-type printer or an ink jet-type plotter. Recently, the liquid ejecting apparatus has been applied to various manufacturing apparatuses due to its characteristics of being capable of causing a very small amount of liquid to land to a predetermined position with accuracy. For example, the liquid ejecting apparatus is applied to a display manufacturing apparatus that manufactures a color filter such as a liquid crystal display, an electrode producing apparatus that produces an electrode, such as an organic electro luminescence (EL) display or a surface-emitting display (FED), and a chip manufacturing apparatus that manufactures a bio chip (biochemical component). A recording head for the image recording apparatus ejects liquid-phase ink, a color-material ejecting head for the display manufacturing apparatus ejects solutions of respective color materials which are red (R), green (G), and blue (G). In addition, an electrode-material ejecting head for the electrode producing apparatus ejects a liquid-phase electrode material and a bio-organic material ejecting head for the chip manufacturing apparatus ejects a solution of bio-organic material.

The liquid ejecting head mounted on the liquid ejecting apparatus includes, for example, a piezoelectric element, a heating element, or an electrostatic actuator as a pressure generating unit that causes a pressure change to occur in a liquid inside a pressure chamber which communicates with a nozzle from which the liquid is ejected and ejects the liquid from the nozzle. In the liquid ejecting apparatus, a drive waveform (drive pulse) generated by a drive signal generator is applied to the pressure generating unit and thereby the pressure generating unit is driven, which causes the liquid to be ejected. In a configuration in which, while the liquid ejecting head is caused to perform a relative movement with respect to a landing target of the liquid, the liquid ejecting head ejects the liquid from the nozzle and a landing pattern such as an image is formed on the landing target, the liquid ejecting apparatus is configured to cause the drive waveform to be generated at a timing based on position information generated in accordance with the movement of the liquid ejecting head so as to cause the liquid to land at an aimed position on the landing target with accuracy.

In the liquid ejecting apparatus in the related art, acceleration or deceleration of the liquid ejecting head is performed in a region separated from the outer side of a liquid ejecting region in a head movement direction on the landing target (for example, in the case of the printer, region on which an image or the like is practically recorded on a recording sheet) such that ejection of the liquid is not performed in acceleration and deceleration sections. That is, the ejection of the liquid is performed only in a constant speed section of the liquid ejecting head. Incidentally, recently, a configuration is employed, in which the acceleration/deceleration (operation of direction change) of the liquid ejecting head is performed even in the liquid ejecting region on the landing target and ejection of the liquid is performed in these acceleration and deceleration sections so as to shorten the moving distance of the liquid ejecting head as much as possible such that the configuration satisfies a request for improvement of a speed of the liquid ejection process and miniaturization of the apparatus. However, when the ink is ejected using the same drive waveform in both the constant speed section and the acceleration and deceleration sections, the moving speed of the liquid ejecting head is slower compared to a constant moving speed of the liquid ejecting head in the constant speed section. Thus, a landing position of the liquid is varied on the landing target. Therefore, a configuration is also proposed, in which the drive waveform is changed between the constant speed section and the acceleration/deceleration sections and thereby landing variation of the liquid is suppressed (for example, see JP-A-2000-280469).

Incidentally, in the liquid ejecting apparatus described above, there is a concern that behavior of a meniscus in a nozzle is disturbed due to residual vibration after ejection of the liquid, which affects the subsequent ejection operation of the liquid. Therefore, in the constant speed section, the ejection operation is adjusted to a generation timing of the drive waveform (that is, ejection timing of the liquid) such that the effect of the residual vibration is as small as possible. However, since the moving speed of the liquid ejecting head is not constant in the acceleration/deceleration sections, the generation timing of the drive waveform is not constant either. Thus, the timing causes the ejection of the liquid to be unstable due to the residual vibration as described above in some cases.

SUMMARY

An advantage of some aspects of the invention is to provide a liquid ejecting apparatus that suppress an effect of residual vibration in acceleration/deceleration sections and thus, has uniform ejection characteristics of a liquid and a method of controlling the liquid ejecting apparatus.

According to an aspect of the invention, there is provided a liquid ejecting apparatus that includes a liquid ejecting head which ejects a liquid from a nozzle by applying a drive waveform to a pressure generating unit and driving the pressure generating unit and executes a liquid ejection process while causing the liquid ejecting head to scan a landing target of a liquid. A plurality of drive waveforms, each of which has a different timing at which to eject the liquid with respect to a reference signal that regulates a cycle of liquid ejection, is selectively applied to the pressure generating unit according to the moving speed of the liquid ejecting head.

In this configuration, it is desired to employ a configuration in which a drive waveform is selectable from a first drive waveform adjusted to a first ejection timing with respect to the reference signal, a second drive waveform adjusted to a second ejection timing which is earlier than the first ejection timing with respect to the reference signal, and a third drive waveform adjusted to a third ejection timing which is later than the first ejection timing with respect to the reference signal.

In this case, the plurality of drive waveforms, each of which has a different timing at which to eject the liquid with respect to the reference signal that regulates the cycle of the liquid ejection, is selectively applied to the pressure generating unit according to the moving speed of the liquid ejecting head, and thereby ejection of the liquid at a timing at which the ejection of the liquid is unstable is prevented from being performed. Thus, a significant change in the ejection characteristics such as a flying speed or amount (weight or volume) of the liquid that is ejected in the acceleration/deceleration section due to the residual vibration after the ejection is suppressed. Accordingly, it is possible to suppress failure such as a shift in a landing position of the liquid on the landing target.

In this configuration, it is desired to employ a configuration in which the second drive waveform is set such that the flying speed of the liquid which is ejected is decreased compared to the case of the first drive waveform, and the third drive waveform is set such that the flying speed of the liquid which is ejected is increased compared to the case of the first drive waveform.

In this case, the second drive waveform is set such that the flying speed of the liquid which is ejected is decreased compared to the case of the first drive waveform, and the third drive waveform is set such that the flying speed of the liquid which is ejected is increased compared to the case of the first drive waveform. Thus, even when the liquids are ejected at different timings, in order to avoid a timing at which the ejection of the liquid is unstable, it is possible to suppress the shift in the landing position on the landing target.

Further, in this configuration, it is desired to employ a configuration in which the reference signal is generated according to scanning of the liquid ejecting head.

According to another aspect of the invention, there is provided a method of controlling a liquid ejecting apparatus that includes a liquid ejecting head that ejects a liquid from a nozzle by applying a drive waveform to a pressure generating unit and driving the pressure generating unit and executes a liquid ejection process while causing the liquid ejecting head to scan a landing target of a liquid. The method includes: applying selectively a plurality of drive waveforms, each of which has a different timing at which to eject the liquid with respect to a reference signal that regulates a cycle of liquid ejection, to the pressure generating unit according to the moving speed of the liquid ejecting head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments according to the invention are described with reference to the accompanying drawings. According to an embodiment which will be described later, various limitations thereto are provided as appropriate and specific examples of the invention; however, as long as there is no indication in the following description that the invention is particularly limited, the range of the invention is not limited to these aspects. In addition, hereinafter, an ink jet-type recording apparatus (hereinafter, printer) is described as an example of a liquid ejecting apparatus according to the invention.

Figure 1:
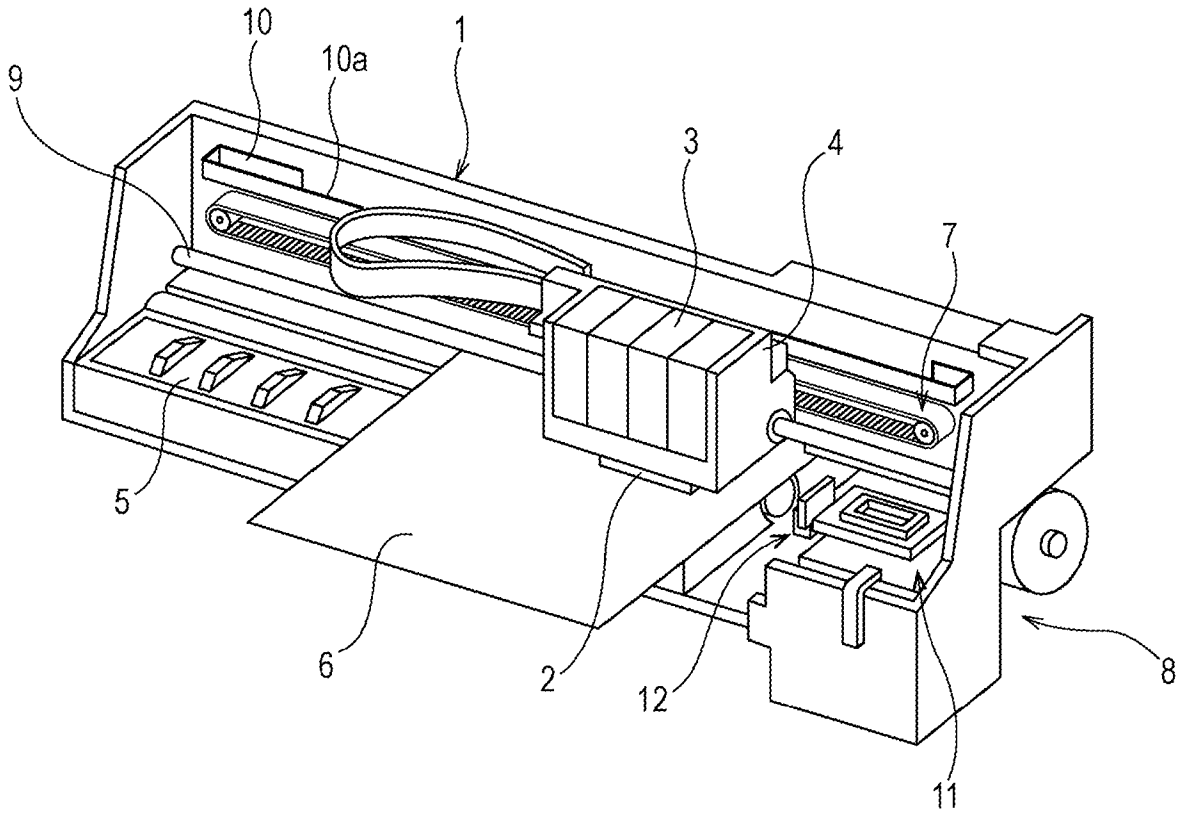
FIG. 1 is a perspective view illustrating an internal configuration of a printer.

FIG. 1 is a perspective view illustrating a configuration of a printer 1. The printer 1 to which a recording head 2 that is a kind of liquid ejecting head is attached is schematically configured to include a carriage 4 to which an ink cartridge 3 that is a kind of liquid supplying source is attached detachably, a platen 5 which is disposed under the recording head 2 during a recording operation, a carriage moving mechanism 7 that causes the carriage 4 to move back and forth (move relatively) in the width direction of the recording medium 6 (a kind of landing target) such as a recording sheet, that is in a main scanning direction, and a paper-sheet delivery mechanism 8 that transports the recording medium 6 in a sub scanning direction orthogonal to the main scanning direction. In the printer 1, the recording media 6 are transported sequentially by the paper-sheet delivery mechanism 8 (FIG. 3) which will be described later along with causing ink which is a kind of liquid to be ejected from a nozzle 30 of the recording head 2 (refer to FIG. 2) while causing the recording head 2 mounted on the carriage 4 to move relatively on the recording medium 6 in the main scanning direction, and then the ink lands on the recording medium 6 and an image or the like is recorded. It is possible to employ a configuration in which the ink cartridge 3 is disposed on the main body side of the printer and ink in the ink cartridge 3 is sent to the recording head 2 side through a supply tube.

The carriage 4 is attached to and axially supported by a guide rod 9 crossing over in the main scanning direction, and thus is configured to move along the guide rod 9 in the main scanning direction by an operation of the carriage moving mechanism 7. A position of the carriage 4 in the main scanning direction is detected by a linear encoder 10 and the detection signal, that is, an encoder pulse (type of position information) is transmitted to a controller 43 (refer to FIG. 3) of a printer controller 38. The linear encoder 10 is a kind of position information output unit and outputs an encoder pulse EP in accordance with a scanning position of the recording head 2 as the position information in the main scanning direction. The linear encoder 10 according to the present embodiment includes a scale 10*a* (encoder film) stretched inside a housing of the printer 1 in the main scanning direction and a photointerrupter (not illustrated) attached on the back surface of the carriage 4. The scale 10*a* has a plurality of printed opaque stripes which crosses over the front surface of a transparent base film in a band-width direction, for example. The stripes have the same width and are formed in a regular pitch, for example a pitch corresponding to 180 dpi in a bandlongitudinal direction. In addition, the photointerrupter is configured to include a pair of light-emitting element and a light-receiving element disposed to face each other and to output the encoder pulse EP according to a difference between a light-receiving state on a transparent portion of the scale 10*a* and a light-receiving state on a stripe portion.

Since the stripes have the same width and are formed in a regular pitch, the encoder pulse EP is output at a regular interval when a moving speed of the carriage 4 is constant, whereas, when the moving speed of the carriage 4 is not constant (during acceleration or deceleration), the interval of the encoder pulses EP is changed according to the moving speed of the carriage. These encoder pulses EP are input to the controller 43. Therefore, the controller 43 can recognize a position and a moving speed (acceleration) of the recording head 2 mounted on the carriage 4 on the basis of the received encoder pulses EP. That is, for example, the received encoder pulses EP are counted and, thereby, it is possible to recognize the position of the carriage 4. In addition, it is possible to grasp the moving speed and acceleration based on the counted number of the encoder pulses (that is, distance) and time needed for the counting. Accordingly, the controller 43 recognizes a scanning position of the carriage 4 (recording head 2) and can control the recording operation of the recording head 2 on the basis of the encoder pulses EP from the linear encoder 10.

In an outer end region from a recording region within a moving range of the carriage 4, a home position that is a base point of the scanning of the carriage is set. According to the present embodiment, at the home position, a capping member 11 that seals a nozzle formed surface (nozzle plate 24: refer to FIG. 2) of the recording head 2 and a wiper member 12 to wipe the nozzle formed surface are disposed. The printer 1 is configured to be able to perform so-called bidirectional recording of recording a character or an image on the recording medium 6 in both directions during the forward movement of the carriage 4 toward the end opposite to the home position and during the rearward movement of the carriage 4 to return to the home position from the opposite end.

Figure 2:
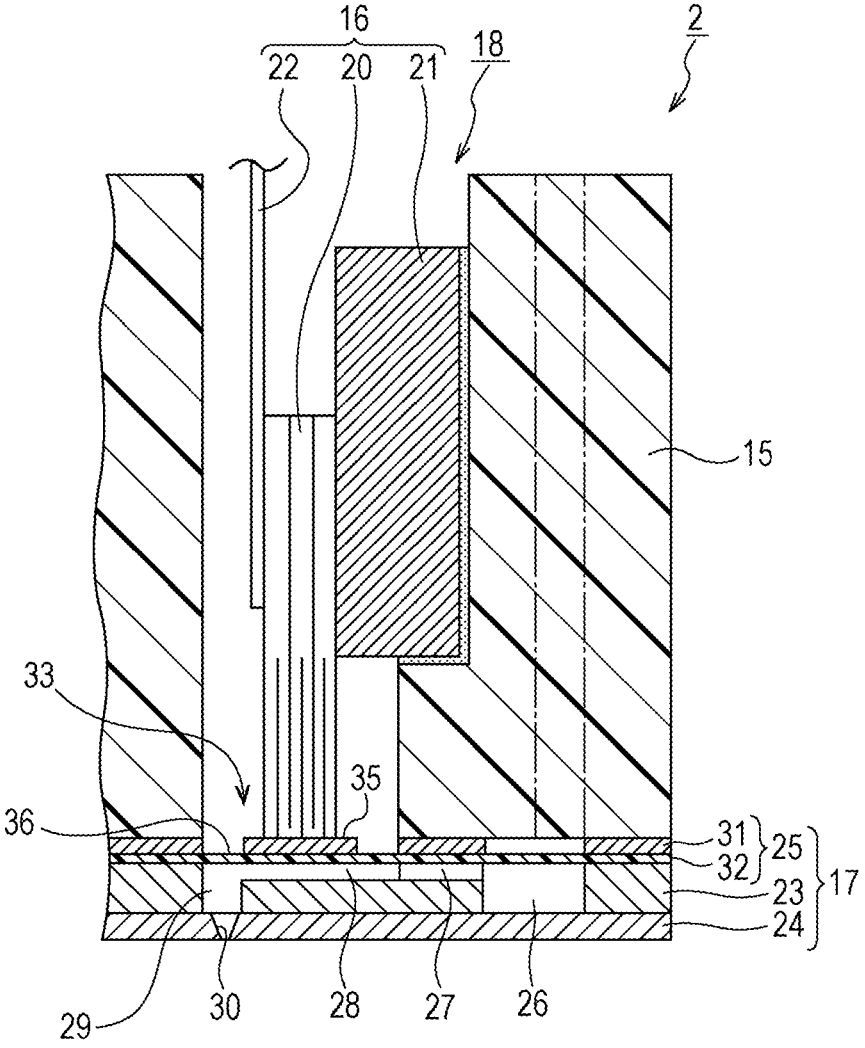
FIG. 2 is a cross-sectional view of main components illustrating a configuration of a recording head.

FIG. 2 is a cross-sectional view of main components illustrating a configuration of the recording head 2. The recording head 2 includes a case 15, a vibrator unit 16 that is accommodated in the case 15, and a flow path unit 17 that is joined to a bottom surface (tip end surface) of the case 15. The case 15 is, for example, made of an epoxy resin and an accommodation space section 18 for accommodating the vibrator unit 16 is formed therein. The vibrator unit 16 includes a piezoelectric element 20 that functions as a kind of the pressure generating unit, a fixation plate 21 to which the piezoelectric element 20 is joined, and a flexible cable 22 for supplying the drive signal or the like to the piezoelectric element 20. The piezoelectric element 20 is formed as a laminated type manufactured by cutting a piezoelectric plate, in which a piezoelectric layer and an electrode layer are laminated alternately, into a comb-teeth shape and is a piezoelectric element having a longitudinal vibration mode in which the piezoelectric element can be expanded and contracted (electric field transverse effect type) in a direction orthogonal to a lamination direction (electric field direction).

The flow path unit 17 is configured by joining the nozzle plate 24 to one surface of a flow path formed substrate 23 and a vibration plate 25 to the other surface of the flow path formed substrate 23. A reservoir 26 (common liquid chamber), an ink supplying port 27, a pressure chamber 28, a nozzle communication port 29, and the nozzle 30 are provided in the flow path unit 17. A series of ink flow paths from the ink supplying port 27 through the pressure chamber 28 and the nozzle communication port 29 to the nozzle 30 is formed corresponding to each nozzle 30.

The nozzle plate 24 described above is a thin plate made of metal such as stainless steel in which a plurality of the nozzles 30 is bored in rows at a pitch (for example, 180 dpi) corresponding to a dot forming density. The nozzles 30 are provided in rows and the plurality of nozzle rows (nozzle group) is provided in the nozzle plate 24 and a nozzle row is configured to have, for example, 180 nozzles 30.

The vibration plate 25 has a double structure in which an elastic body film 32 is laminated on the front surface of a support plate 31. According to the present embodiment, the vibration plate 25 is manufactured using composite plate materials in which a stainless steel plate that is a kind of metal plate is used as the support plate 31 and a resin film as the elastic body film 32 is laminated on the front surface of the support plate 31. A diaphragm section 33 that changes the volume of the pressure chamber 28 is provided on the vibration plate 25. The diaphragm section 33 described above is manufactured by partially removing the support plate 31 by using an etching process. That is, the diaphragm section 33 is formed to have an insular section 35 to which a tip end surface of a free end section of the piezoelectric element 20 is joined and a thin elastic section 36 that surrounds the insular section 35.

Since the tip end surface of the piezoelectric element 20 is joined to the insular section 35 described above, the free end section of the piezoelectric element 20 is expanded and contracted and, thereby, it is possible to change the volume of the pressure chamber 28. A pressure change in the ink inside the pressure chamber 28 occurs due to the volume change. The recording head 2 is configured to utilize the pressure change and to eject the ink from the nozzle 30.

Figure 3:
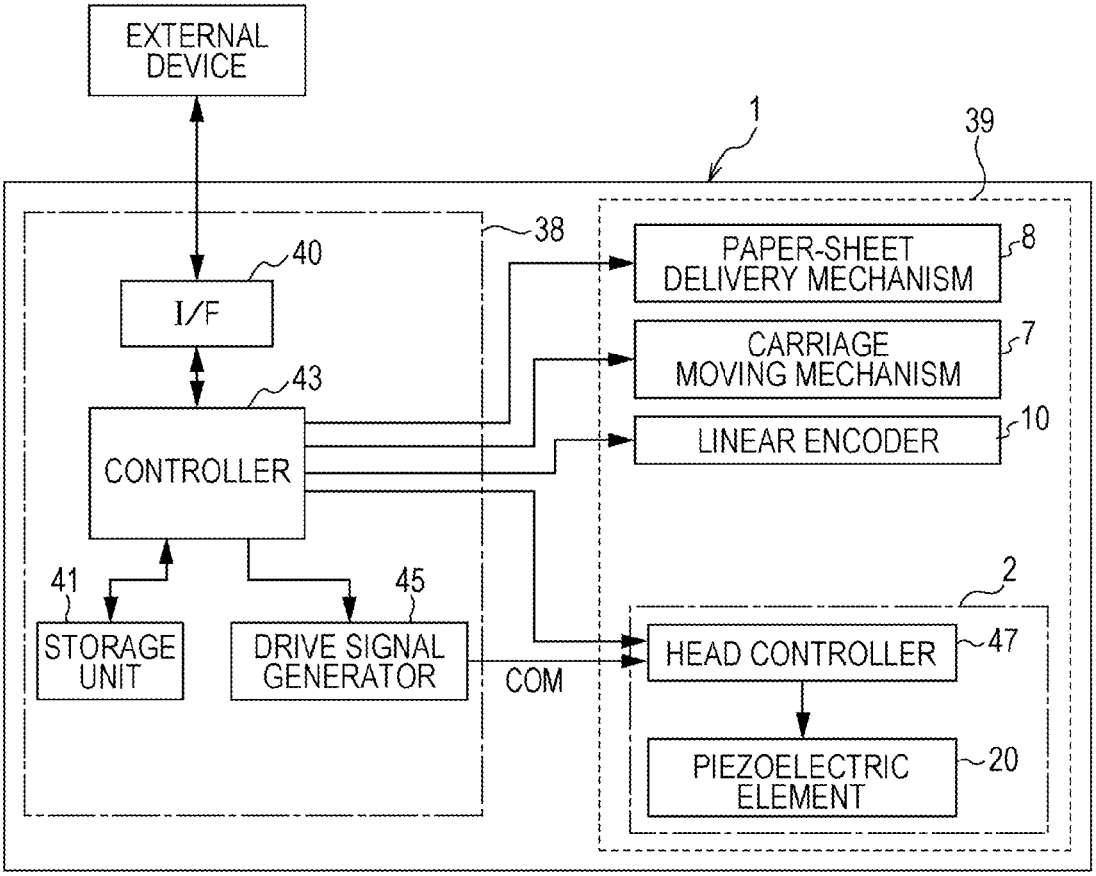
FIG. 3 is a block diagram illustrating an electrical configuration of the printer.

FIG. 3 is a block diagram illustrating an electrical configuration of the printer 1. An external device is an electronic device such as a computer, a digital camera, or a mobile phone. In order to cause an image or text to be printed on the recording medium 6 such as a recording sheet in the printer 1, the external device transmits print data in accordance with the image or the like to the printer 1. The printer 1 according to the present embodiment includes a print engine 39 including the paper-sheet delivery mechanism 8, the carriage moving mechanism 7, the linear encoder 10, the recording head 2, or the like, and the printer controller 38.

The printer controller 38 is a control unit that performs control of each component of the printer. The printer controller 38 according to the present embodiment includes an external interface (I/F) unit 40, a controller 43, a storage unit 41, and a drive signal generator 45. The external interface unit 40 performs transmission and reception of status data of the printer when the print data or a printing command is transmitted from the external device to the printer 1 or status information of the printer 1 is output to the external device side. The controller 43 is a computation processing system for performing control of the entire printer. The storage unit 41 is an element that stores data which is used for a program or various types of control of the controller 43 and includes a ROM, a RAM, and a nonvolatile random access memory (NVRAM). The controller 43 controls each unit according to the program stored in the storage unit 41. In addition, the controller 43 according to the present embodiment generates ejection data representing at which timing and from which nozzle 30 of the recording head 2 the ink is ejected during the recording operation based on the print data from the external device and transmits the ejection data to a head controller 47 of the recording head 2. The drive signal generator 45 (drive waveform generating unit) generates an analog signal on the basis of waveform data related to a waveform of a drive signal, amplifies the signal, and then generates a drive signal (drive pulse) illustrated in FIG. 4A, 4B, or 4C.

Figure 4A:
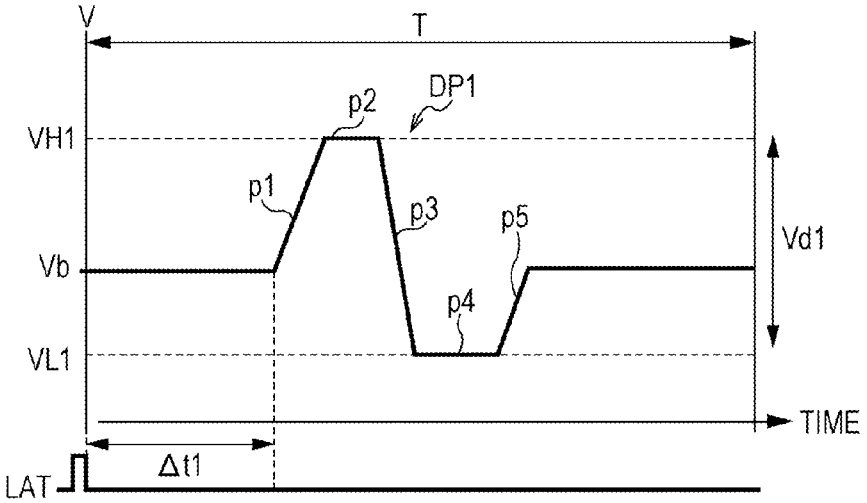
FIGS. 4A to 4C are diagrams of waveforms illustrating configurations of drive pulses.
Figure 4B:
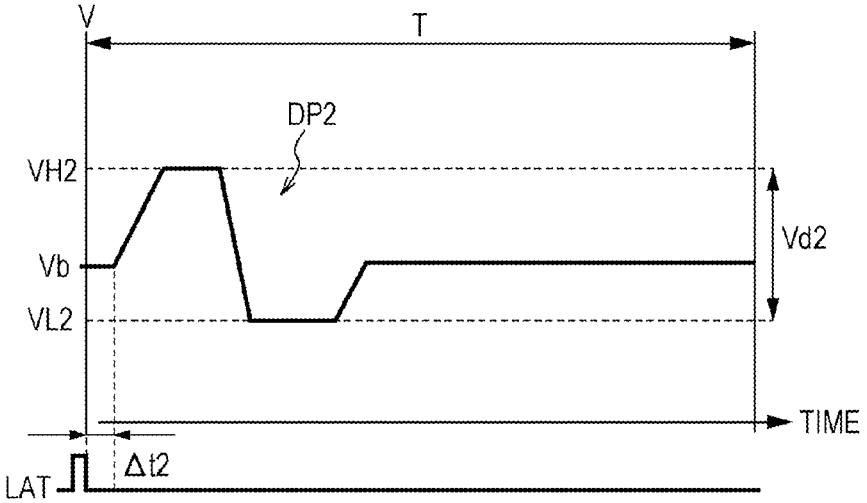
Figure 4C:
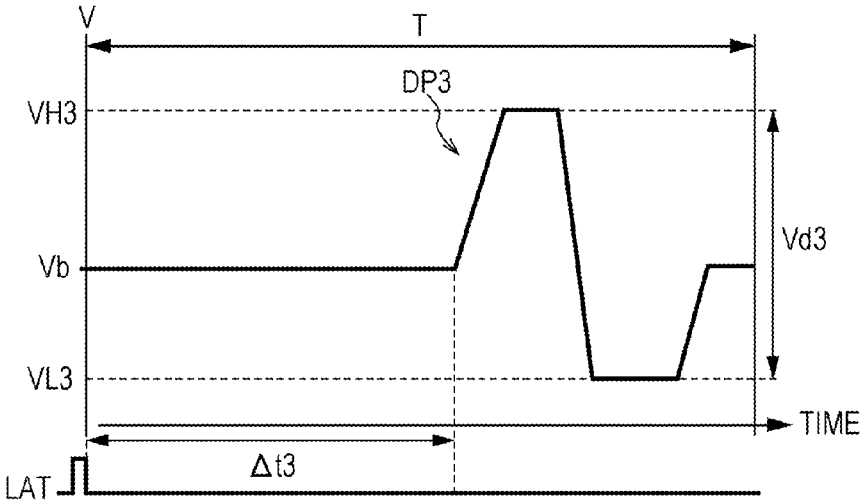

FIGS. 4A to 4C are diagrams of waveforms illustrating examples of configurations of drive pulses which are generated by the drive signal generator 45. The drive pulses are generated repeatedly from the drive signal generator 45 for each unit cycle T which is regulated by a latch signal LAT that is generated according to the scanning of the recording head 2. The unit cycle T corresponds to, for example, a period of movement of the nozzle 30 by a distance corresponding to that of one pixel of an image or the like which is printed on the recording medium 6. According to the present embodiment, three types of ejection drive pulses DP1 to DP3 are generated, including a first ejection drive pulse DP1 (corresponding to the first drive waveform according to the invention) illustrated in FIG. 4A, a second ejection drive pulse DP2 (corresponding to the second drive waveform according to the invention) illustrated in FIG. 4B, and a third ejection drive pulse DP3 (corresponding to the third drive waveform according to the invention) illustrated in FIG. 4C. When the recording head 2 moves in a section corresponding to the recording region on the recording medium 6 in a printing process, one of these drive pulses DP1 to DP3 is selectively applied to the piezoelectric element 20 provided in each pressure chamber 28. Shapes of the ejection drive pulses DP1 to DP3 are not limited to illustrated examples, but it is possible to employ various shapes of waveforms according to an amount or the like of ink that is ejected from the nozzle 30. In addition, these drive pulses DP1 to DP3 may be configured to be included in the same drive signal when the drive pulses DP1 to DP3 can be generated so as not to interfere with each other.

The ejection drive pulses DP1 to DP3 are all drive pulses (corresponding to drive waveforms according to the invention) which are generated so as to cause ejection of the ink from the nozzle 30 and each ejection drive pulse includes a preliminary expansion portion p1, an expansion hold portion p2, a contraction portion p3, a contraction hold portion p4, and an expansion-returning portion p5. The preliminary expansion portion p1 is an element of the waveform which causes the piezoelectric element 20 to be displaced such that the pressure chamber 28 expands from a reference volume (initial volume) corresponding to a reference potential Vb to an expanded volume and the expansion hold portion p2 is an element of the waveform which causes the expanded volume of the pressure chamber 28 to be maintained. In addition, the contraction portion p3 is an element of the waveform which causes the piezoelectric element 20 to be displaced such that the pressure chamber 28 contracts from the expanded volume to a contracted volume which is less than the reference volume and ejects the ink from the nozzle 30 and the contraction hold portion p4 is an element of the waveform which causes the contracted volume of the pressure chamber 28 to be maintained. The expansion-returning portion p5 is an element of the waveform which causes the piezoelectric element 20 to be displaced such that the pressure chamber 28 returns to the reference volume from the contracted volume.

Figure 5:
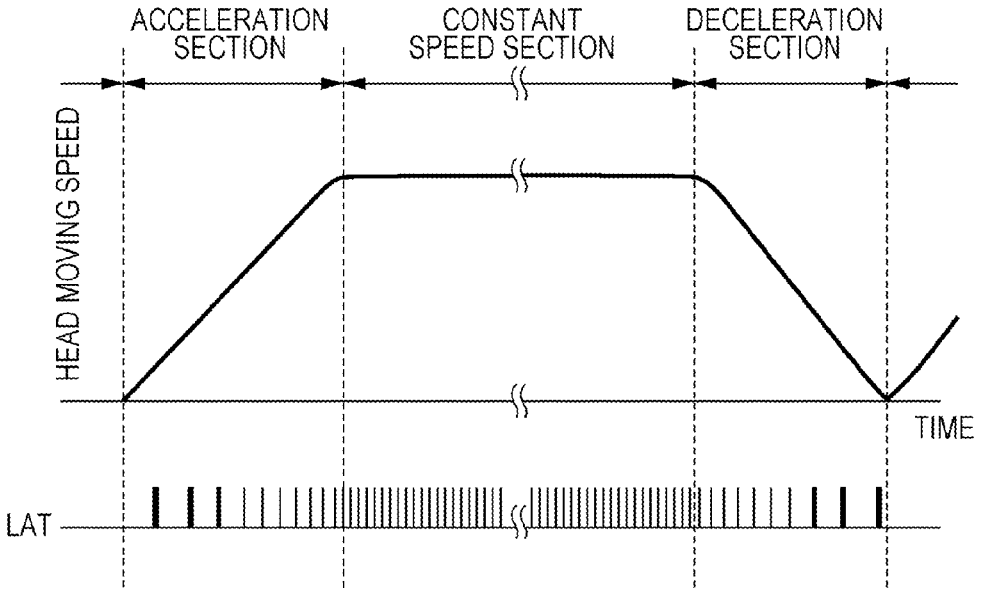
FIG. 5 is a timing chart illustrating a change of a moving speed of the recording head associated with a generation timing of a latch signal LAT.

Here, FIG. 5 is a timing chart illustrating the change of a moving speed of the recording head 2 associated with the generation timing of a latch signal LAT. The printer 1 according to the invention is configured to eject ink from the recording head 2 even during acceleration movement or deceleration movement (acceleration/deceleration section) of the carriage 4 and to perform recording of the image or text in the recording region (liquid ejecting region) on the recording medium 6 as the landing target. Incidentally, since, in the acceleration/deceleration section, the moving speed of the carriage 4 is slower than the moving speed in the constant speed section and is not constant, a generation interval of the encoder pulse EP based on the inconstant moving speed is not constant. Since the drive signal generator 45 is configured to output a drive signal (drive pulse DP) under a condition of receiving the latch signal LAT based on the encoder pulse EP, a generation cycle of the drive signal is not constant in the acceleration/deceleration section either. Therefore, when the ejection of the ink is performed by using the same drive pulse as in the case of the constant speed section in the acceleration/deceleration section, the behavior of a meniscus in the nozzle is disturbed due to residual vibration after the ejection of the ink and the subsequent ejection operation of the liquid ink is performed unstably in some cases. Specifically, for example, in the case of a timing at which, compared to the residual vibration after ejection of ink in a cycle, pressure vibration which is produced when the ink is ejected in the next cycle is extremely strong or extremely weak, a flying speed, a flying direction, and an amount of the ink ejected from the nozzle 30 are changed from a target value. As a result, a streak, color unevenness, or the like is produced on the image or the like recorded on the recording medium 6 and image quality is lowered. Taking into account such problems, in the printer 1 according to the invention, the ejection drive pulses DP1 to DP3 described above are selectively applied to the piezoelectric element 20 according to the moving speed of the recording head 2 and, thereby, the failure described above is decreased, which will be described as follows, hereinafter.

The first ejection drive pulse DP1 illustrated in FIG. 4A is generated in the constant speed section and the acceleration/deceleration section. Time from an LAT signal to the beginning of the first ejection drive pulse DP1 (beginning of the preliminary expansion portion p1) is set to Δt1. When the ink is continuously ejected in the constant speed section, the Δt1 is set to be an ejection timing at which a flying speed or an amount of the ink that is ejected is stable with no significant change from a designed target value. A timing at which the ink is ejected by the first ejection drive pulse DP1 that is generated after Δt1 from the LAT signal is a first ejection timing according to the invention. The second ejection drive pulse DP2 illustrated in FIG. 4B is a drive pulse that is generated in the acceleration/deceleration section. Time Δt2 from the LAT signal to the beginning of the second ejection drive pulse DP2 is set to a value indicating a time that is shorter than Δt1. That is, the second ejection drive pulse DP2 is generated at a timing which is earlier than the first ejection drive pulse DP1 in the unit cycle T. A timing at which the ink is ejected by the second ejection drive pulse DP2 that is generated after Δt2 from the LAT signal is a second ejection timing according to the invention. Similarly, the third ejection drive pulse DP3 illustrated in FIG. 4C is a drive pulse that is generated in the acceleration/deceleration section. Time Δt3 from the LAT signal to the beginning of the third ejection drive pulse DP3 is set to a value indicating time that is longer than Δt1. That is, the third ejection drive pulse DP3 is generated at a timing later than the first ejection drive pulse DP1 in the unit cycle T. A timing at which the ink is ejected by the third ejection drive pulse DP3 that is generated after Δt3 from the LAT signal is a third ejection timing according to the invention.

These ejection drive pulses DP1 to DP3 are set to have different voltages from each other (potential difference from the lowest potential to the highest potential). Specifically, a voltage Vd2 of the second ejection drive pulse DP2 is set to be lower than a voltage Vd1 of the first ejection drive pulse DP1. In addition, a voltage Vd3 of the third ejection drive pulse DP3 is set to be higher than the voltage Vd1 of the first ejection drive pulse DP1. That is, these ejection drive pulses DP1 to DP3 have a relationship of Vd2<Vd1<Vd3. The higher the voltage of the ejection drive pulse, the more a flying speed Vm of the ink which is ejected from the nozzle 30 is increased. The lower the voltage of the ejection drive pulse, the more the flying speed Vm of the ink which is ejected from the nozzle 30 is decreased. Accordingly, the second ejection drive pulse DP2 is a drive waveform in which the flying speed of the ink which is ejected from the nozzle 30 is set to be lower than that in the case of the first ejection drive pulse DP1. The third ejection drive pulse DP3 is a drive waveform in which the flying speed of the ink which is ejected from the nozzle 30 is set to be higher than that in the case of the first ejection drive pulse DP1.

Figure 6:
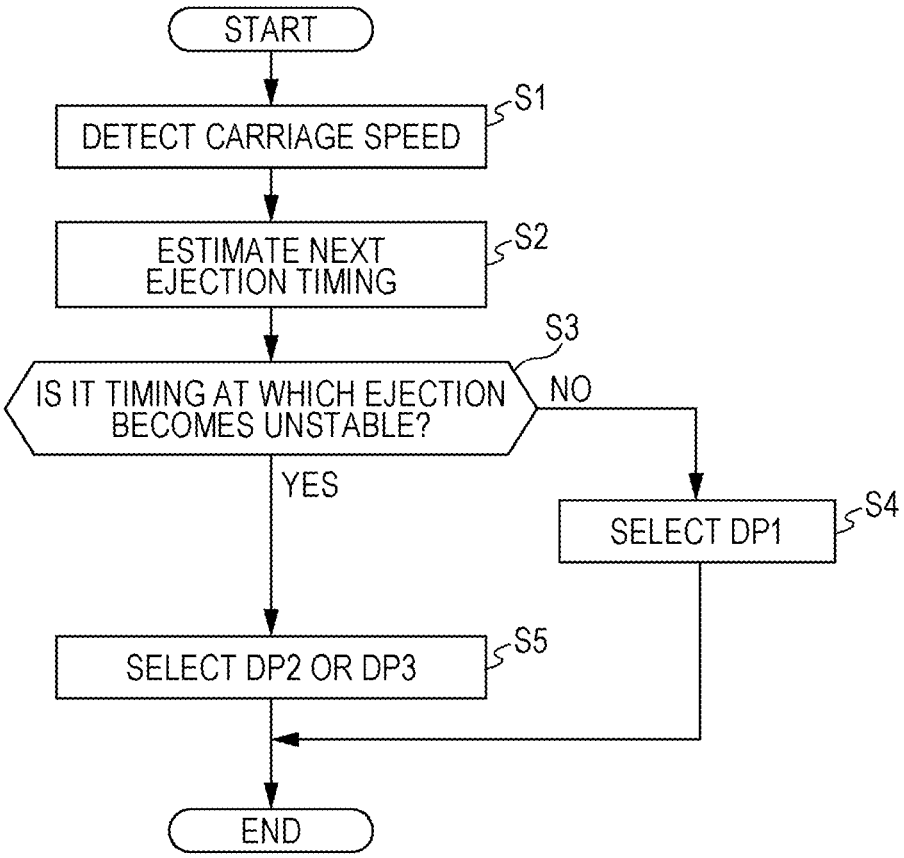
FIG. 6 is a flowchart illustrating selection control of a drive pulse in a recording process.
Figure 7A:
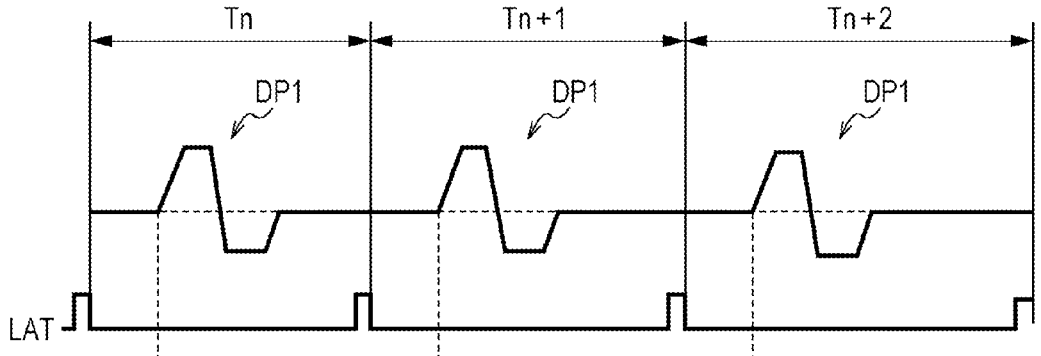
FIGS. 7A and 7B are timing charts illustrating selection examples of the drive pulses.
Figure 7B:
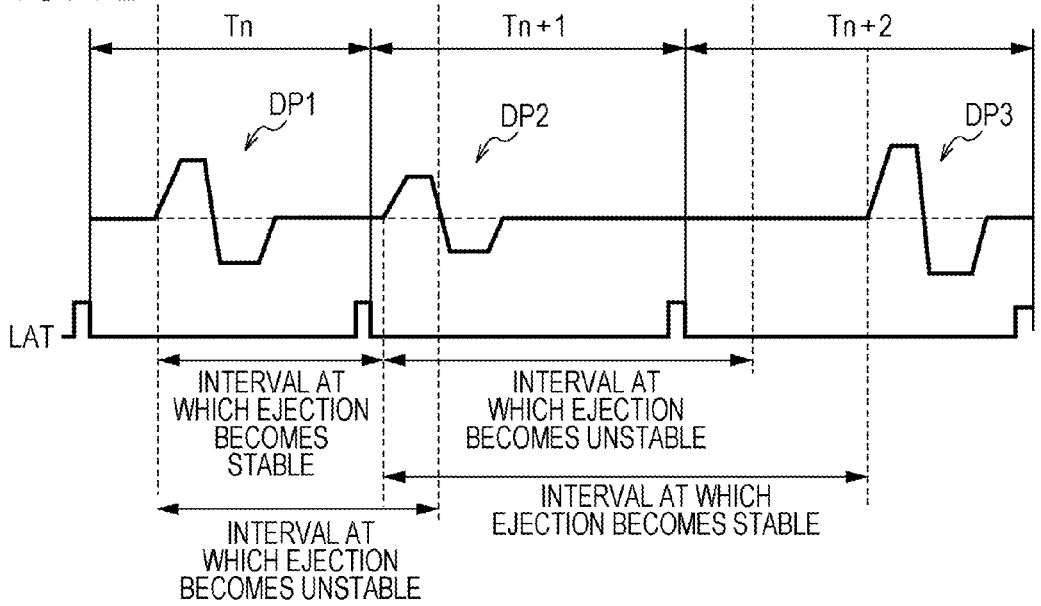

FIG. 6 is a flowchart illustrating selection control of a drive pulse in the recording process (printing process). In addition, FIGS. 7A and 7B are timing charts illustrating selection examples of the drive pulses. Here, FIG. 7A illustrates a selection pattern of a case where the ejection does not become unstable even in a case where the ink is ejected by using the first ejection drive pulse DP1 in the deceleration section. In addition, FIG. 7B illustrates an example of a selection pattern of a case where the ejection becomes unstable in a case where the ink is ejected by using the first ejection drive pulse DP1 in the deceleration section. As illustrated in FIGS. 7A and 7B, the generation interval of the LAT signal becomes gradually longer in the deceleration section. In contrast, the LAT signal is generated at an equal interval in the constant speed section and the generation interval of the LAT signal becomes gradually shorter in the acceleration section.

In a case where the recording process such as that for an image is performed while the recording head 2 mounted on the carriage 4 is caused to scan the recording medium 6, the position of the carriage 4 in the main scanning direction is detected by the linear encoder 10 and the encoder pulse which is the detection signal is transmitted to the controller 43. The controller 43 detects the moving speed (acceleration) of the carriage 4 on the basis of the encoder pulse (step S1). In addition, the controller 43 estimates the timing at which subsequent ejection of the ink is performed based on the moving speed (step S2). Specifically, for example, a timing is predicted, at which the LAT signal of the next cycle is generated on the basis of the moving speed (acceleration) of the carriage 4 and a moving distance (for example, 1/360 inches) of the carriage 4 in one cycle and it is predicted that the next ejection timing of the ink comes after the time Δt1 from the LAT signal to the beginning of the first ejection drive pulse DP1 in the cycle.

The controller 43 determines whether or not the next ejection timing of the ink is a timing at which the ejection becomes unstable (step S3). That is, in a relationship with the residual vibration of the meniscus produced by the ejection of the ink in a current cycle Tn, the controller 43 determines whether or not values of the characteristics of ejection are significantly changed from the target values when the ink is ejected by using the first ejection drive pulse DP1 in a next cycle Tn+1. In a case where it is determined that the ejection does not become unstable when the ink is ejected by using the first ejection drive pulse DP1 in the next cycle Tn+1 (or the carriage 4 moves in the constant speed section) (No), the process proceeds to step S4. The controller 43 causes the head controller 47 to perform control of selecting the first ejection drive pulse DP1 in the next cycle Tn+1 and applying the first ejection drive pulse DP1 to the piezoelectric element 20 (FIG. 7A). Meanwhile, in a case where it is determined that the ejection becomes unstable when the ink is ejected by using the first ejection drive pulse DP1 in the next cycle Tn+1 (Yes), the process proceeds to step S5. The controller 43 causes the head controller 47 to perform control of selecting either the second ejection drive pulse DP2 or the third ejection drive pulse DP3 in the next cycle Tn+1 and applying the selected drive pulse to the piezoelectric element 20. Specifically, for example, as illustrated in FIG. 7B, after the ink is ejected by using the first ejection drive pulse DP1 in the cycle Tn, in a case where the ejection of the ink becomes unstable when the ink is ejected by using the first ejection drive pulse DP1 in the next cycle Tn+1, that is, in a case where an interval between the first ejection drive pulse DP1 in the cycle Tn and the first ejection drive pulse DP1 in the cycle Tn+1 is an interval at which the ejection becomes unstable, the second ejection drive pulse DP2 or the third ejection drive pulse DP3 is selected such that the ejection is performed at a timing shifted from the timing at which the ejection becomes unstable. That is, in the example of FIG. 7B, the second ejection drive pulse DP2 is selected in the cycle Tn+1 and, thus, an interval between the first ejection drive pulse DP1 in the cycle Tn and the second ejection drive pulse DP2 in the cycle Tn+1 becomes an interval at which the ejection becomes stable. Accordingly, the ejection is prevented from being unstable in the cycle Tn+1. Similarly, after the ink is ejected by using the second ejection drive pulse DP2 in the cycle Tn+1, in a case where the ejection of the ink becomes unstable when the ink is ejected by using the first ejection drive pulse DP1 in the next cycle Tn+2, that is, in a case where the interval between the second ejection drive pulse DP2 in the cycle Tn+1 and the first ejection drive pulse DP1 in the cycle Tn+2 is an interval at which the ejection becomes unstable, the third ejection drive pulse DP3 is selected in the cycle Tn+2 and, thus, it is possible to avoid a timing at which the ejection becomes unstable from occurring. Selection of either the second ejection drive pulse DP2 or the third ejection drive pulse DP3 in step S5 is not limited to the pattern illustrated in the present embodiment, but the generation timing of the drive pulse from the LAT signal may be set to be earlier or later so as to avoid the timing at which the ejection becomes unstable.

Figure 8:
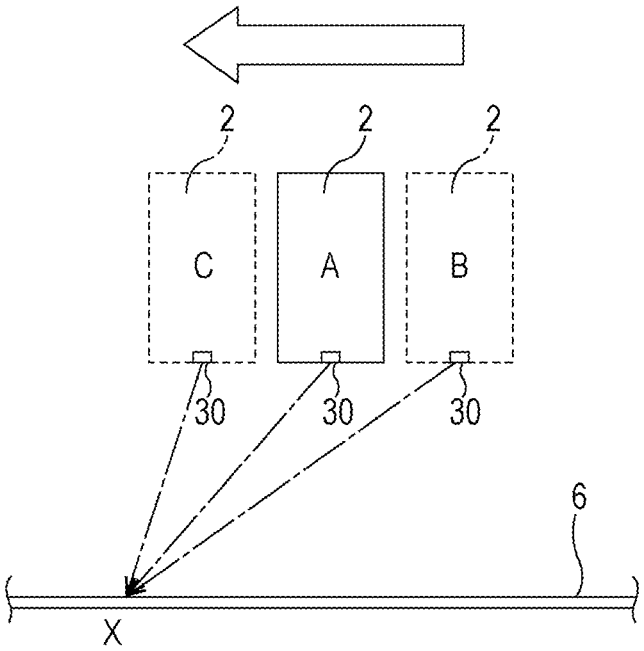
FIG. 8 is a diagram schematically illustrating an ejection timing at which ejection drive pulses are selected at predetermined cycles, respectively, and a flying direction of ejected ink.

Here, FIG. 8 is a diagram schematically illustrating an ejection timing at which ejection drive pulses DP1 to DP3 are selected at predetermined cycles, respectively, and a flying direction of ejected ink. A direction represented by an arrow is a scanning direction (traveling direction) of the recording head 2 mounted on the carriage 4. In FIG. 8, in a case where the first ejection drive pulse DP1 is selected, the ink is ejected from the nozzle 30 at a position represented by A and flies toward the recording medium 6. The ink ejected from the nozzle 30 flies obliquely over the recording medium 6 due to inertia from movement of the recording head 2 (carriage 4) and lands at a position represented by X on the recording medium 6. In addition, in a case where the second ejection drive pulse DP2 is selected, the ink is ejected from the nozzle 30 at a position represented by B at which the timing is earlier than that at A. As described above, since the second ejection drive pulse DP2 is set to have a slower flying speed of the ink than that in a case of the first ejection drive pulse DP1, flying time from the ejection of the ink to landing on the recording medium 6 becomes long and the moving distance of the ink in the main scanning direction is also increased by an equivalent amount. Therefore, ink ejected at a position of B by the second ejection drive pulse DP2 lands on the recording medium 6 at a position closer to a landing position X of the ink ejected at a position of A by the first ejection drive pulse DP1. Similarly, in a case where the third ejection drive pulse DP3 is selected, the ink is ejected from the nozzle 30 at a position represented by C at which the timing is later than that at A. Since the third ejection drive pulse DP3 is set to have a higher flying speed of the ink than that in a case of the first ejection drive pulse DP1, flying time from the ejection of the ink to landing on the recording medium 6 becomes short and a moving distance of the ink in the main scanning direction is also decreased by an equivalent amount. Therefore, ink ejected at a position of C by the third ejection drive pulse DP3 lands at a position closer to a landing position X on the recording medium 6.

As described above, in the printer 1 according to the invention, according to the moving speed of the recording head 2 in the acceleration section or in the deceleration section, the ejection drive pulses DP1 to DP3 described above are selectively applied to the piezoelectric element 20 and, thus, the great change of the ejection characteristics such as the flying speed or amount (weight or volume) of the ink that is ejected in the acceleration/deceleration section, due to the residual vibration after the ejection of the ink is suppressed. Accordingly, it is possible to suppress a shift of the landing position of the ink on the recording medium 6 or size variations of the dots. In addition, according to the present embodiment, since the second ejection drive pulse DP2 is set to have the lower flying speed of the ink that is ejected than that in the case of the first ejection drive pulse DP1 and the third ejection drive pulse DP3 is set to have the higher flying speed of the ink that is ejected than that in the case of the first ejection drive pulse DP1, it is possible to suppress the shift of the landing position on the recording medium 6 even when the ink is ejected at a different timing so as to avoid the unstable ejection.

The invention is not limited to each embodiment described above, and various modifications can be performed on the basis of the aspects of the invention.

For example, according to the embodiment described above, the voltages Vd1 to Vd3 of the ejection drive pulses DP1 to DP3 become different and, thus, an example of a configuration is described, in which the flying speeds of the inks which are ejected by these drive pulses are different from each other, but the configuration is not limited thereto. For example, it is possible to employ a configuration in which the voltages of the ejection drive pulses DP1 to DP3 are arranged to be constant, or in which each ejection drive pulse has a different slope of the contraction portion p3 that drives the piezoelectric element 20 so as to contract the pressure chamber 28 such that the ink is ejected from the nozzle 30 and thus the flying speeds of the inks that are ejected by these drive pulses are different from each other. Specifically, whereas the slope of the contraction portion p3 of the second ejection drive pulse DP2 is set to be gentler than the slope of the contraction portion p3 of the first ejection drive pulse DP1, the slope of the contraction portion p3 of the third ejection drive pulse DP3 may be set to be steep.

According to the embodiment described above, a so-called longitudinal vibration type piezoelectric element 20 is illustrated as an example of the pressure generating unit, but there is no limitation thereto, and it is possible to employ a so-called flexural vibration type piezoelectric element. In this case, according to the embodiment described above, the drive pulse DP illustrated as an example becomes a waveform of which a change direction of the potential, that is, the top and bottom thereof, is inverted.

In addition, an example of the pressure generating unit is not limited to the piezoelectric element, and the invention can be applied even to a case where various pressure generating units such as an electrostatic actuator which changes a volume of a pressure chamber using a heating element that generates air bubbles inside the pressure chamber or an electrostatic force are used.

As long as an apparatus is the liquid ejecting apparatus that applies the drive pulse to the pressure generating unit, drives the pressure generating unit, and thereby ejects a liquid in a liquid flow path, the apparatus is not limited to the printer. However, the invention can be applied to various ink jet-type recording apparatuses such as a plotter, a facsimile apparatus, a copy machine, or a textile printing apparatus that causes ink to land on a fabric (printing material) which is a kind of landing target from a liquid ejecting head and performs the printing.

What is claimed is:

1. A liquid ejecting apparatus, comprising a liquid ejecting head configured to eject a liquid from a nozzle by selecting one of a plurality of drive waveforms and applying the selected one of the drive waveforms to a pressure generating unit and driving the pressure generating unit, the liquid ejecting apparatus being configured to execute a liquid ejection process while causing the liquid ejecting head to scan a landing target of a liquid, wherein the plurality of drive waveforms comprises:

a first drive waveform which has a first timing at which to eject the liquid with respect to a reference signal that regulates a cycle of liquid ejection, and at least one additional drive waveform which has an additional, different timing at which to eject the liquid with respect to the reference signal;

wherein selecting the one of the plurality of drive waveforms comprises:

detecting a moving speed of the liquid ejecting head;

determining, based on the moving speed of the liquid ejecting head, whether the liquid ejection process would become unstable if the first drive waveform were applied as the next applied drive waveform;

when the ejection would become unstable, selecting the additional drive waveform; and when the ejection would not become unstable, selecting the first drive waveform.

2. The liquid ejecting apparatus according to claim 1, wherein the at least one additional drive waveform comprises a second drive waveform which has a second timing which is earlier than the first timing, and a third drive waveform which has a third timing which is later than the first timing.

3. The liquid ejecting apparatus according to claim 2, wherein the second drive waveform is set such that a second drive waveform flying speed of the liquid which is ejected is lower than a first drive waveform flying speed of the first drive waveform, and wherein the third drive waveform is such that a third drive waveform flying speed of the liquid which is ejected is higher than the first drive waveform flying speed.

4. The liquid ejecting apparatus according to claim 1, wherein the reference signal is generated according to scanning of the liquid ejecting head.

5. A method of controlling a liquid ejecting apparatus, the liquid ejecting apparatus comprising a liquid ejecting head configured to eject a liquid from a nozzle, the method comprising:

selecting one of a plurality of drive waveforms;

applying the selected one of the drive waveforms to a pressure generating unit;

driving the pressure generating unit, and executing a liquid ejection process while causing the liquid ejecting head to scan a landing target of a liquid, wherein the plurality of drive waveforms comprises:

a first drive waveform which has a first timing at which to eject the liquid with respect to a reference signal that regulates a cycle of liquid ejection, and at least one additional drive waveform which has an additional, different timing at which to eject the liquid with respect to the reference signal;

wherein selecting the one of the plurality of drive waveforms comprises:

detecting a moving speed of the liquid ejecting head;

determining, based on the moving speed of the liquid ejecting head, whether the liquid ejection process would become unstable if the first drive waveform were applied as the next applied drive waveform;

when the ejection would become unstable, selecting the additional drive waveform; and when the ejection would not become unstable, selecting the first drive waveform.

* * * * *